US007201777B2

(12) United States Patent
Booker, Jr.

(10) Patent No.: US 7,201,777 B2
(45) Date of Patent: Apr. 10, 2007

(54) NONWOVEN FABRIC HAVING LOW ION CONTENT AND METHOD FOR PRODUCING THE SAME

(76) Inventor: Archer E. D. Booker, Jr., 602 Perrin Dr., Spartanburg, SC (US) 29307

( * ) Notice: Subject to any disclaimer, the term of this patent is extended or adjusted under 35 U.S.C. 154(b) by 225 days.

(21) Appl. No.: 10/109,357

(22) Filed: Mar. 28, 2002

(65) Prior Publication Data

US 2003/0182730 A1 Oct. 2, 2003

(51) Int. Cl.
*D04H 1/00* (2006.01)
*D04H 1/58* (2006.01)
*D01G 25/00* (2006.01)

(52) U.S. Cl. ..... 8/115.51; 28/104; 28/167; 264/171.1; 428/98; 428/108; 428/357; 428/364; 428/395; 442/327; 442/340; 442/351; 442/361; 442/401

(58) Field of Classification Search ..... 442/327, 442/340, 361, 401, 351; 8/115.51; 19/296; 264/210.8, 210, 171.1; 28/104, 107, 166, 28/167; 428/288, 98, 108, 357, 364, 395
See application file for complete search history.

(56) References Cited

U.S. PATENT DOCUMENTS

| | | | | |
|---|---|---|---|---|
| 4,340,563 A | | 7/1982 | Appel et al. | 264/518 |
| 4,837,902 A | | 6/1989 | Dischler | 26/1 |
| 4,918,795 A | | 4/1990 | Dischler | 26/1 |
| 4,925,722 A | * | 5/1990 | Jeffers et al. | 428/131 |
| 5,069,735 A | | 12/1991 | Reynolds | 156/497 |
| 5,229,181 A | | 7/1993 | Daiber et al. | 428/58 |
| 5,244,724 A | * | 9/1993 | Antonacci et al. | 442/414 |
| 5,271,995 A | | 12/1993 | Paley et al. | 428/224 |
| 5,460,655 A | | 10/1995 | Pisacane et al. | 134/6 |
| 5,822,835 A | | 10/1998 | Dischler | 28/167 |
| 5,899,785 A | * | 5/1999 | Groten et al. | 442/334 |
| 5,970,583 A | * | 10/1999 | Groten et al. | 19/296 |
| 6,178,607 B1 | | 1/2001 | Dischler | 28/167 |
| 6,189,189 B1 | | 2/2001 | Morin et al. | 28/166 |
| 6,548,431 B1 | * | 4/2003 | Bansal et al. | 442/327 |

FOREIGN PATENT DOCUMENTS

| | | |
|---|---|---|
| EP | PCT/EP00/11584 | 11/2000 |
| GB | 2 142 225 A | 6/1984 |
| WO | PCT/US94/08496 | 8/1994 |
| WO | PCT/US01/06588 | 3/2001 |

* cited by examiner

*Primary Examiner*—Douglas McGinty
*Assistant Examiner*—Preeti Kumar
(74) *Attorney, Agent, or Firm*—Terry T. Moyer; Brenda D. Wentz

(57) ABSTRACT

The present invention relates to a nonwoven fabric having a relatively low level of ionic contaminates which is achieved by exposing the fabric to a deionized water wash, preferably, in-line with the nonwoven production process, thereby eliminating, or at least reducing, the need for an expensive and time consuming cleanroom laundering. The fabric is primarily comprised of continuous filament fibers and may be manufactured into such end-use products as cleaning wipes and protective clothing for cleanrooms and surface coating operations, such as automotive paintrooms. Also encompassed within this invention is a method for producing a nonwoven fabric having a relatively low level of ionic contaminates.

9 Claims, No Drawings

NONWOVEN FABRIC HAVING LOW ION CONTENT AND METHOD FOR PRODUCING THE SAME

BACKGROUND OF THE INVENTION

The present invention relates to a nonwoven fabric having a relatively low level of ionic contaminates which is achieved by exposing the fabric to a deionized water wash, preferably, in-line with the nonwoven production process, thereby eliminating, or at least reducing, the need for an expensive and time consuming cleanroom laundering. The fabric is primarily comprised of continuous filament fibers and may be manufactured into such end-use products as cleaning wipes and protective clothing for cleanrooms and surface coating operations, such as automotive paintrooms. Also encompassed within this invention is a method for producing a nonwoven fabric having a relatively low level of ionic contaminates.

Various types of fabrics have historically been manufactured into wiping cloths, or wipers, for utilization in a number of different cleaning applications, such as industrial cleanrooms, preparing surfaces for coatings, and general cleaning. Each different application emphasizes certain standards that these types of wipers should attain. For example, wipers utilized in cleanrooms must meet stringent performance standards. These standards are related to sorbency and contamination, including maximum allowable particulate, unspecified extractable matter and individual ionic contaminates. The standards for particulate contaminant release are especially rigorous and various methods have been devised to meet them. For example, U.S. Pat. No. 5,271,995 to Paley et al. describes a wiper having fused borders, the sealed edge of the wipers being present to reduce contamination caused by small fibers. U.S. Pat. No. 5,229,181 to Diaber, et al. describes a knit fabric tube, only two edges of which must be cut and sealed, thereby reducing the contamination caused by loose fibers from the edges. U.S. Pat. No. 5,271,995 to Paley et al. describes a wiper for a cleanroom environment that has reduced inorganic contaminants through the use of a specific yarn, namely "nylon bright." U.S. Pat. No. 5,069,735 to Reynolds describes a procedure to cut the fabric into pieces using a hot air jet in the range of 600 to 800 degrees F. to melt the fibers, forming a sealed edge product with reduced loose fiber contamination.

Finishes to improve the sorbency of wipers made of hydrophilic fibers, such as polyester, have also been employed. For example, wiping cloths having a textile substrate and a porous polymer coating made from the "sulphonation products of cross-linked polymers containing sulphonated aromatic residues" are disclosed in GB 2 142 225 A.

Ions such as Na, Li, $NH_4$, K, Mg, Ca, F, Cl, $NO_4$, $PO_4$, and $SO_4$ are generally inherently present in a textile fabric. These ions may be detrimental to a cleanroom environment, especially in the semi-conductor industry, because the ions: (a) can be transferred to the silicon wafer circuitry; (b) can cause corrosion on the wafer circuitry, and (c) can cause short circuit in the wafer circuitry. It is known that deionized water may be used to reduce or eliminate these ions from the fabric so they may be suitable for use, for example, in cleanroom applications. Deionized water acts as an attractant to the ions in the fabric so that the ions are pulled oft the fabric and into the water, which can then be discarded or filtered for reuse. Typically, ion reduction or removal is achieved using a cleanroom laundry to wash the fabric, often in the form of wipers, to reduce ion content. However, this process is very expensive and time consuming and may detrimentally affect the physical properties of the fabric due to the conditions the wipers encounter during the wash cycle, such as overly aggressive agitation and rinsing and exposure to high temperature water and chemicals.

Wipers may be made from knitted, woven, or non-woven textile fabrics. The fabric is typically cut into 9-inch by 9-inch squares. If a wiper is intended for use in a cleanroom environment, it is generally desirable to wash the fabric or wipers in a cleanroom laundry in order to remove and minimize contamination of the wipers prior to packaging. The cleanroom laundry may employ special filters, surfactants, sequestrants, purified water, etc. to remove oils, reduce particle count, and extract undesirable ion contaminates. As mentioned previously, the laundering process, which is expensive and time consuming, may be overly aggressive and may detrimentally affect the physical properties of the fabric. For example, any finishes applied to the surface of the fabric may be removed during the laundering process and the fabric edges may become unraveled or frayed, thereby leading to an undesirable increase in fiber particle contamination. Thus, careful and constant monitoring of the laundering equipment employed is necessary in order control the agitation, volume and duration of rinsing, and speed and duration of extraction.

As interest in this industry has grown, manufacturers have worked to develop new yarns and fabrics that might easily and cost effectively fulfill this need for contaminant-free fabrics. One such advancement has been made in the area of spun-bonded nonwovens. Spun-bonded nonwoven production processes are well known in the textile arts and are described in various patents such as, for example, U.S. Pat. No. 4,692,618 to Dorschner, et al.; U.S. Pat. No. 4,340,563 to Appel, et al.; U.S. Pat. No. 3,338,992 to Kinney; U.S. Pat. No. 3,341,394 to Kinney; and U.S. Pat. No. 3,502,538 to Levy. Historically, the nonwoven webs produced from these processes have been produced for functional end-uses, such as for air filters, vehicle trunk linings, and roofing materials, with relatively low cost and little or no emphasis on characteristics such as drape and hand and moisture absorbency which are of considerable interest, for example, in cleanroom wiping cloths and protective clothing.

However, recent developments in the area of spun-bonded fiber production have resulted in the creation of nonwoven fabrics with improved drape, hand, and moisture absorption characteristics ("hand" typically describes the tactile qualities of a fabric such as softness, firmness, elasticity, etc.). For example, U.S. Pat. Nos. 5,899,785 and 5,970,583, both assigned to Firma Carl Freudenberg, describe a spun-bonded nonwoven lap of very fine continuous filament and the process for making such nonwoven lap using traditional spun-bonded nonwoven manufacturing techniques. Such references disclose, as important raw materials, spun-bonded composite, or multi-component, fibers that are longitudinally splittable by mechanical or chemical action into microdenier size individual fibers. However, while this nonwoven production process may be cheaper and simpler than a comparable knitted or woven process, the fabric produced therein would likely need to be processed at a cleanroom laundry to meet the requirements for end-use products, such as, for examples, wipers for a cleanroom or a paintroom.

Thus, an efficient, cost effective method is needed for achieving a nonwoven fabric having a relatively low level of particle contaminates and sufficient hand, drape, and moisture absorbency characteristics required for end uses such as cleanroom and paintroom wipers and protective clothing.

SUMMARY OF THE INVENTION

In light of the foregoing discussion, it is one object of the current invention to achieve a nonwoven fabric having low ion content that is suitable for use as a wiping cloth or a protective garment in cleanrooms or surface coating operations, such as automotive paintrooms. The fabric is typically comprised of synthetic continuous filament fibers, and may more specifically be comprised of multi-component continuous filament fiber that is splittable along its length by chemical or mechanical action, which generally enhances the hand, drape, and moisture absorption properties of the fabric. The fabric is generally achieved by exposing the nonwoven material to a deionized water rinse, preferably in-line with the nonwoven production process. The deionized fabric may then be further processed, for example, into wiping cloths of various sizes or protective garments, that meet or exceed the requirements for cleanrooms or surface coating operations, without requiring exposure to a cleanroom laundering process, thereby saving substantial time and expense, and preserving the fabric's finishing characteristics.

A further object of the current invention is to achieve a method for producing a nonwoven fabric having low ion content that may be suitable for use as a wiping cloth or a protective garment in cleanrooms or surface coating operations, such as automotive paintrooms. Typically, the nonwoven fabric is manufactured according to various nonwoven textile-manufacturing processes known to those skilled in the art. The fabric may then be exposed, preferably via an in-line production process, to a deionized water rinse, a drying process, and a take-up process. Thereafter, the fabric may undergo further processing into cleaning wipes or protective garments. The wipes and/or garments may then be used in cleanroom or surface coating applications without necessarily requiring a cleanroom laundering process, thereby saving substantial time and expense, and preserving the fabric's finishing characteristics.

Other objects, advantages, and features of the current invention will occur to those skilled in the art. Thus, while the invention will be described and disclosed in connection with certain preferred embodiments and procedures, such embodiments and procedures are not intended to limit the scope of the current invention. Rather, it is intended that all such alternative embodiments, procedures, and modifications are included within the scope and spirit of the disclosed invention and limited only by the appended claims and their equivalents.

DETAILED DESCRIPTION OF THE INVENTION

The current invention discloses a nonwoven fabric having reduced ion content, which may be incorporated into articles for use in cleanrooms and surface coating operations, and a method for producing such fabric. The fabric is first produced according to standard nonwoven manufacturing processes known to those skilled in the art. These production processes include spun-bonding, melt-blowing, wet laid, dry laid, thermal bonding, flash spinning, SMS (this is a combination of spun-bond, melt-blown, and spun-bond), SMMS (this is a combination of spun-bond, melt-blown, melt-blown, and spun-bond), and combinations thereof.

The fabric may be comprised of continuous filament fibers that are unitary, single component fibers, multi-component fibers, or any combination thereof. The multi-component fibers may be splittable along their length by mechanical or chemical action. For example, U.S. Pat. Nos. 5,899,785 and 5,970,583, both assigned to Firma Carl Freudenberg and both incorporated herein by reference, describe a spun-bonded nonwoven lap of very fine continuous filament and the process for making such nonwoven lap using traditional spun-bonded nonwoven manufacturing techniques. Such references disclose, as important raw materials, spun-bonded composite, or multi-component, fibers that are longitudinally splittable by mechanical or chemical action. One example of mechanical action includes subjecting the spun-bonded nonwoven lap, or fabric, formed from such materials to high-pressure water jets (i.e., hydroentanglement) in order to separate the multi-component filaments into their individual filaments.

The fibers may be of any fiber size, but they are preferably characterized by having a fiber size of less than 5 denier. Further, the fibers, when extruded as multi-component fibers, may be preferably characterized by having individual filament sizes of less than 1 denier.

The fibers may be comprised of various fiber types including polyester, such as, for example, polyethylene terephthalate, polytriphenylene terephthalate, and polybutylene terephthalate; polyamide, such as, for example, nylon 6 and nylon 6,6; polyolefins, such as, for example, polypropylene, polyethylene, and the like; polyaramides, such as, for example, Kevlar®; polyurethanes; polylactic acid; and any combination thereof.

After the nonwoven fabric is produced, it is typically then exposed to a deionized water rinse to remove ions from the fabric. Exposure is preferable when executed in-line with the nonwoven production process, however, it may be executed in a process separate from the nonwoven production process. The deionized water rinse may be accomplished by immersion coating, padding, spraying, or by any other technique whereby one can apply a controlled amount of a liquid to a fabric. If, for example, a spray bar is used to apply the deionized water rinse, a vacuum slot may be used in conjunction with the spray bar to remove excess water from the fabric. Following the deionized water rinse, the fabric is then dried. Drying may be accomplished by heating the fabric, drying the fabric at room temperature, or any combination thereof. Heating can be accomplished by any technique typically used in textile manufacturing operations, such as dry heat from a tenter frame, microwave energy, infrared heating, steam, superheated steam, autoclaving, etc. or any combination thereof. In choosing a drying method that involves the use of heat, it may be preferable to dry the fabric at a temperature of 300 degrees F. or less, especially if the fabric is comprised, at least partially, of polyester. Commonly assigned U.S. Pat. No. 6,189,189, incorporated herein by reference, discloses a method of producing a low contaminant wiper with high absorbency by heatsetting a polyester textile fabric at 300 degrees F. or less to eliminate or reduce the formation of low molecular weight polymers or oligomers, also known as "trimer particles," which bloom to the surface of the fabric when exposed to high heatsetting temperatures. These trimer particles, when released from the fabric surface, lead to a detrimental increase in particle contamination.

After drying, the fabric is generally rolled up, or taken up, and may be further processed into a variety of end-use products, such as, for example, wipers of varying sizes or protective garments. Wipers, although ideal for use in cleanrooms or areas where coatings are being applied to a surface, they may be used for any end-use where it is preferable to have a fabric with low particle contamination. Furthermore, protective garments such as booties, gowns, aprons, masks, gloves, etc., that are required for use in cleanrooms or surface coating environments, may have application in other industries, such as in hospital operating rooms, dental offices, veterinary surgical rooms, or any other industry where low contaminant fabrics are desirable. These end-uses may include sterile drapes, tents, blankets, dental bibs, gauze, bandages, tape, etc.

In one potentially preferred, non-limiting embodiment of the current invention, it may be desirable to expose the nonwoven fabric to mechanical processing techniques which increase the thickness and water absorption properties of the fabric. Commonly-assigned U.S. Pat. Nos. 4,837,902, 4,918,785, 5,822,835, and 6,178,607, which are incorporated herein by reference, describe fabric conditioning processes that project low pressure, high velocity streams of gaseous fluid against the fabric web in various directions compared to the direction of fabric web flow substantially tangential to the web of the fabric. This air impingement process typically creates saw-tooth waves having small bending radii which travel down the fabric thereby breaking up, or weakening, some fiber-to-fiber bonds in the web so as to increase the fabric's hand, drape, thickness, and moisture absorption properties. The process may be added in-line with the nonwoven production process either before or after a deionized water rinse. For example, in producing a spunbonded nonwoven fabric, the fabric may be exposed to this air impingement process after a hydroentanglement step while the fabric is still wet. The nonwoven fabric may then be rinsed with deionized water and dried as previously described.

Yet another potentially preferred embodiment includes using deionized water, rather than tap water, to hydroentangle the fibers of a nonwoven fabric, preferably a spunbonded nonwoven fabric. The fabric may be hydroentangled with deionized water expelled from high-velocity water jets and then exposed to one or more of the following treatments in any order: a) air impingement, b) rinsing again with deionized water, and c) drying.

In another potentially preferred, non-limiting embodiment of the present invention, it may be desirable to add a chemical finish to the surface of the fabric to enhance aesthetic and/or performance characteristics such as water absorption, water repellency, particle attraction, etc. The chemical finish may be applied at any time after the fabric has been formed. It may be preferable to add the chemical finish after a hydroentangling process, and if desired, after treatment with an air impingement process, but typically prior to the final deionized water rinse. The application of a chemical to the fabric may be accomplished by immersion coating, padding, spraying, foam coating, or by any other technique whereby one can apply a controlled amount of a liquid suspension to an article. Employing one or more of these application techniques may allow the chemical to be applied to the fabric in a uniform manner. An example of a chemical that may be used is disclosed in commonly assigned international publication number WO 01/80706. This publication discloses a particle attracting finish that may be applied to a textile fabric for the purpose of attracting and removing particulate contaminants from a surface.

The following examples illustrate various embodiments of the present invention but are not intended to restrict the scope thereof.

All examples utilized 100 g/m$^2$ spun-bonded nonwoven fabric comprised of continuous multi-component splittable fibers which have been exposed to the process of hydroentanglement with high-pressure water to cause the multi-component fibers to split, at least partially, along their length into individual polyester and nylon 6,6 fibers, according to processes described in the two Freudenberg patents earlier incorporated by reference. The fabric, known by its product name as Evolon®, was obtained from Firma Carl Freudenberg of Weinheim, Germany. The fabric is comprised of approximately 65% polyester fibers and approximately 35% nylon 6,6 fibers. The fabric is typically available in at least two variations, standard and point-bonded. The standard variation has not been subjected to further bonding processes, such as point bonding. Point-bonding is the process of binding thermoplastic fibers into a nonwoven fabric by applying heat and pressure so that a discrete pattern of fiber bonds is formed.

One standard for evaluating low ion content fabrics is the Institute of Environmental Sciences & Technology (IEST), Contamination Control Division Recommended Practice 0004.2, which may be cited as IEST-RP-CC-004, "Evaluating Wiping Materials Used in Cleanrooms and Other Controlled Environments. The fabric described in the examples was tested for ion content, according to Section 6.1.2 of Recommended Practice, and is cited as Short Term Extraction Test IEST-RP-CC-004 §6.12, both before and after a deionized water rinse.

EXAMPLE 1

A 9-inch by 9-inch piece of standard Evolon® fabric was placed in a beaker of deionized water and agitated for approximately 10 seconds. The fabric was removed from the beaker and the excess water was squeezed out of the fabric by a gloved hand. The fabric was then tested, in its wet state, for ion content. The results are measured in parts per billion (ppb) and are shown in Table 1 below.

TABLE 1

Ion Content of Standard Evolon ® Fabric Before and After Deionized (Dl) Water Rinse

| Ion | Before Dl Rinse (ppb) | After Dl Rinse (ppb) |
|---|---|---|
| Na | 149,200 | <1 |
| Li | <1 | <1 |
| $NH_4$ | <1 | <1 |
| K | <1 | <1 |
| Mg | <1 | <1 |
| Ca | 19,833 | 3420 |
| F | 1100 | 347 |
| Cl | 76,396 | 120 |
| $NO_4$ | 34,367 | <1 |
| $PO_4$ | 1 | 493 |
| $SO_4$ | 37,333 | 940 |

The results in Table 1 show that there was no change in ion content for Li, $NH_4$, K, and Mg, but that the ion content for $PO_4$ increased. The increase in $PO_4$ likely comes from the gloves worn by the person performing the fabric testing. This can be reduced, or eliminated, by using a nalgeen tong to handle the fabric, or by having the person performing the test wear a different type of glove. However, Table 1 also shows that there was a substantial decrease in ion content for Na, Ca, F, Cl, $NO_4$, and $SO_4$. These results indicate the effectiveness of washing the nonwoven fabric with deionized water to remove ions from the fabric, thereby eliminating, or at least reducing, the need for expensive and time consuming laundering in a cleanroom laundry. Specifically, the fabric of this invention achieves a low ion content of less than about 10,000 part per billion for every ion shown in Table 1 after a deionized water rinse. More preferably, the fabric of this invention achieves a low ion content of less than about 5,000 parts per billion for every ion shown in Table 1 after a deionized water rinse.

EXAMPLE 2

Example 1 was repeated, except that the fabric used was the point-bonded version of Evolon® (rather than the standard version). The results are measured in parts per billion (ppb) and are shown in Table 2 below.

TABLE 2

Ion Content of Point-bonded Evolon ® Fabric Before and After Deionized (Dl) Water Rinse

| Ion | Before Dl Rinse (ppb) | After Dl Rinse (ppb) |
|---|---|---|
| Na | 150,700 | 2567 |
| Li | <1 | <1 |
| $NH_4$ | <1 | <1 |
| K | <1 | <1 |
| Mg | <1 | <1 |
| Ca | 21,333 | 4707 |
| F | <1 | 273 |
| Cl | 81,200 | 1347 |
| $NO_4$ | 21,933 | <1 |
| $PO_4$ | <1 | 760 |
| $SO_4$ | 37,096 | 1407 |

The results in Table 2 show that there was no change in ion content for Li, $NH_4$, K, and Mg, but that the ion content for $PO_4$ and F increased. As stated above, the increase in $PO_4$ likely comes from the gloves worn by the person performing the fabric testing. This can be reduced, or eliminated, by using a nalgeen tong to handle the fabric, or by having the person performing the test wear a different type of glove. However, Table 2 shows that there was a substantial decrease in ion content for Na, Ca, Cl, $NO_4$, and $SO_4$. Again, these results also indicate the effectiveness of washing the nonwoven fabric with deionized water to remove ions from the fabric, thereby eliminating, or at least reducing, the need for expensive and time consuming laundering in a cleanroom laundry. Specifically, the fabric of this invention achieves a low ion content of less than about 10,000 part per billion for every ion shown in Table 2 after a deionized water rinse. More preferably, the fabric of this invention achieves a low ion content of less than about 5,000 parts per billion for every ion shown in Table 2 after a deionized water rinse.

It is also contemplated to be within the scope of this invention that the process of rinsing a fabric in deionized water to reduce or eliminate ion content may also be used for woven or knitted fabrics. It is likely that the deionized water rinse would be performed in a process separate from the weaving and knitting machines because of the manufacturing layouts typical for these fabric-forming processes usually entails a large number of machines symmetrically arranged together and because water is not normally an integral part of these textile production processes.

Furthermore, the fabric of the present invention may be combined into a composite material such that the composite is comprised of one or more layers of the deionized fabric laminated together with one or more layers of polymeric film. Nonwoven, woven, and knitted fabrics may be included as part of the composite material as well. These composites may have end uses in products such as, for example, in a graphite composite laminate utilized in the aerospace industry for the space shuttle, where contamination is of prime concern because contaminants in this environment could react with liquid oxygen and ignite or explode.

The above description and examples disclose the inventive nonwoven fabric having low ion content and the method for producing such nonwoven fabric. Low ion content is achieved by rinsing the nonwoven fabric in deionized water following the nonwoven production process, preferable in-line with the production process. This is advantageously achieved without the use of a cleanroom laundry, which typically increases the cost, complexity and time consumption of the production process. Furthermore, this method may be used in conjunction with other chemical or mechanical processes to produce a nonwoven fabric having improved aesthetic and/or performance characteristics. Accordingly, this invention provides expanded utility for cleanrooms, surface coating operations, and the medical, dental, and veterinary industry such that the fabric of the invention may be incorporated into wiping cloths, protective apparel, sterile drapes, sheets, tents, bandages, and any other article wherein it is desirable to manufacture an end-use product having low ion content.

These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the scope of the invention described in the appended claims.

I claim:

1. A method for providing a spun-bonded nonwoven fabric having low ion content, the method consisting of:

(a) providing a spun-bonded nonwoven fabric comprised of continuous multi-component fibers that are at least partially split along their length into individual component fibers, wherein the individual component fibers are comprised of polyester fiber and polyamide fiber;

(b) optionally, subjecting the spun-bonded nonwoven fabric to an air impingement surface treatment;

(c) optionally, applying a finishing chemical to the surface of the spun-bonded nonwoven fabric;

(d) subjecting the spun-bonded nonwoven fabric to a deionized water rinse; and (e) drying the spun-bonded nonwoven fabric;

wherein the ions are selected from the group comprised of Na, Li, $NH_4$, K, Mg, Ca, F, Cl, $NO_4$, $PO_4$, and $SO_4$, and wherein the ions are present on the spun-bonded nonwoven fabric at less than about 10,000 parts per billion when tested according to Short Term Extraction Test IEST-RP-CC-004 §6.1.2.

2. The method of claim 1, wherein the spun-bonded nonwoven fabric is subjected to the deionized water rinse in-line with a spun-bonded nonwoven fabric production process.

3. The method of claim 1 wherein the ions are present on the fabric at less than about 5,000 parts per billion, when tested according to Short Term Extraction Test IEST-RP-CC-004 §6.1.2.

4. The method of claim 1, wherein the continuous multicomponent fiber is characterized by having a fiber size of less than 5 denier.

5. The method of claim 1, wherein the individual component fibers are characterized by having a fiber size of less than 1 denier.

6. The method of claim 1, wherein the polyester fiber is comprised of polyester selected from the group consisting of polyethylene terephthalate, polytriphenylene terephthalate, polybutylene terephthalate, and combinations thereof.

7. The method of claim 1, wherein the polyamide fiber is comprised of polyamide selected from the group consisting of nylon 6, nylon 6,6, and combinations thereof.

8. The method of claim 1, wherein the spun-bonded nonwoven fabric is comprised of 65% polyester fiber and 35% polyamide fiber.

9. The method of claim 8, wherein the polyamide fiber is nylon 6,6.

* * * * *